US006293665B1

(12) United States Patent
Pew et al.

(10) Patent No.: US 6,293,665 B1
(45) **Date of Patent: *Sep. 25, 2001**

(54) DUAL CAPILLARITY INK ACCUMULATOR FOR INK-JET

(75) Inventors: Jeffrey K. Pew, Lake Oswego; David C. Johnson, Portland, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,340

(22) Filed: May 17, 1999

Related U.S. Application Data

(63) Continuation of application No. 09/151,377, filed on Sep. 10, 1998, now Pat. No. 6,019,459.

(51) Int. Cl.[7] ..... B41J 2/175
(52) U.S. Cl. ..... 347/87
(58) Field of Search ..... 347/85, 86, 87, 347/94, 92

(56) References Cited

U.S. PATENT DOCUMENTS

| | | | |
|---|---|---|---|
| 4,509,062 | 4/1985 | Low et al. | 347/87 |
| 4,771,295 | 9/1988 | Baker et al. | 347/87 |
| 4,791,438 | 12/1988 | Hanson et al. | 347/87 |
| 4,794,409 | 12/1988 | Cowger et al. | 347/87 |
| 4,831,389 | 5/1989 | Chan | 347/86 |
| 5,010,354 | 4/1991 | Cowger et al. | 347/87 |
| 5,113,199 | 5/1992 | Chan et al. | 347/87 |
| 5,448,818 | 9/1995 | Scheffelin et al. | 29/509 |
| 5,509,140 | 4/1996 | Koitabashi et al. | 347/86 |
| 5,526,030 | 6/1996 | Baldwin et al. | 347/87 |
| 5,537,134 | 7/1996 | Baldwin et al. | 347/85 |
| 5,574,490 | 11/1996 | Gragg et al. | 347/87 |
| 5,583,545 | 12/1996 | Pawlowski, Jr. et al. | 347/7 |
| 5,650,811 | 7/1997 | Seccombe et al. | 347/85 |
| 6,019,459 * | 2/2000 | Pew et al. | 347/85 |

FOREIGN PATENT DOCUMENTS

| | | |
|---|---|---|
| 711 667 * | 1/1987 | (EP) . |
| 071167A1 | 5/1991 | (EP) . |
| 62-005994 * | 1/1987 | (JP) . |

* cited by examiner

*Primary Examiner*—N. Le
*Assistant Examiner*—Michael P Nghiem

(57) ABSTRACT

An ink-jet writing system having a pen and a detachable ink reservoir. The pen includes a dual capillarity ink accumulator wherein a balance is provided such that the pen nozzles will neither drool ink nor suck up air when the pen is decoupled from the reservoir. A high capillarity member and a low capillarity member of the accumulator respond to changes in volume of a gas bubble within the pen to absorb or expel ink when operational and ambient atmospheric pressure changes occur.

20 Claims, 5 Drawing Sheets

DUAL CAPILLARITY INK ACCUMULATOR FOR INK-JET

CROSS REFERENCE TO RELATED APPLICATIONS

This is a continuation of application Ser. No. 09/151,377 filed on Sep. 10, 1998 now U.S. Pat. No. 6,019,459.

BACKGROUND OF THE INVENTION

1. Field of the Invention

The present invention relates generally to ink-jet writing instruments and, more particularly, to an ink-jet system having a pen and a detachable ink reservoir in which the pen includes a mechanism for preventing nozzle drool and air ingestion nozzle depriming.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices,* chapter 13 (Ed R. C. Durbeck and S. Sherr, Academic Press, San Diego, 1988).

FIG. 1 (PRIOR ART) depicts an ink-jet hard copy apparatus, in this exemplary embodiment, a computer peripheral, color printer, 101. A housing 103 encloses the electrical and mechanical operating mechanisms of the printer 101. Operation is administrated by an electronic controller (usually a microprocessor or application specific integrated circuit ("ASIC") controlled printed circuit board, not shown) connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 107, is fed by a suitable paper-path transport mechanism (not shown) to an internal printing station where graphical images or alphanumeric text is created using state of the art dot matrix manipulation techniques. A carriage 109, mounted on a slider 111, scans the print medium. An encoder strip 113 and appurtenant devices are provided for keeping back of the position of the carriage 109 at any given time. A set 115 of individual ink-jet pens, or print cartridges, 117A–117D are releasably mounted in the carriage 109 for easy access (generally, in a full color system, inks for the subtractive primary colors, cyan, yellow, magenta (CYM) and true black (K) are provided). Each pen or cartridge has one or more printhead mechanisms (not seen in this perspective) for "jetting" minute droplets of ink to form dots on adjacently positioned print media. Once a printed page is completed, the print medium is ejected onto an output tray 119. If the set 115 of inking units are reusable pens, one or more off-axis ink reservoirs 121 are provided, including fluidic coupling mechanisms 123 between the reservoirs 121 and the individual pens 117.

Print cartridges are generally fully self-contained inking units intended for one-time use and replacement. Ink-jet pens are inking units which separate semipermanent printhead mechanisms from the ink supply either by having an ink reservoir off-axis from the pen coupled thereto by appropriate fluidic linkage, or a separate, snap-on or press-fit, replaceable, ink supply for each pen. Pens tend to be constructed to use free-ink or other equivalent colorant, toner, or the like, in a contained but unencumbered liquid form rather than in a saturated material (such as polyurethane foam used in some print cartridges) to facilitate the repeated ink supply replacements. The printheads in both cartridges and pens generally require a mechanism to prevent the free flow of ink through the nozzle orifices when the printhead is not activated. Without such control, ink may leak, or "drool," onto the printing surface or into the printer mechanism. Such leaking ink may also build up and cake on the printhead itself, impairing proper operation. Complex pen service stations are often provided as part of the hard copy apparatus where printheads can be wiped or activated to "spit" away excess ink. Moreover, if a proper nozzle pressure balance is not maintained, a printhead can ingest air and "deprime" the nozzles. Complex priming pumps are provided as part of the hard copy apparatus in systems where depriming has been found to be problematic.

To alleviate this problem more directly, many ink-jet printers supply ink from the reservoir to the printhead at a slight under pressure (also referred to in the art as "back-pressure" or "negative pressure" operation), lower than the ambient atmospheric pressure at the printhead. To be effective, this pen back-pressure must be maintained consistently and predictably within a desired operating range. That is, the pen back-pressure must be large enough to prevent the unwanted free flow of ink through the orifices when the pen is not in use, yet at the same time small enough so that the printhead, when activated, can overcome the back-pressure and eject ink droplets in a consistent and predictable manner. This back-pressure will be affected by changes in either or both the ambient atmospheric and the internal pressure conditions. Likewise, temperature variations may cause the ink and air within the ink-jet pen to contract or expand, also affecting the back-pressure. Depending on the exact changes experienced, without such compensation, ink will either drool from the nozzles or air will be ingested through the nozzles. Therefore, these factors must be accounted for and a mechanism incorporated to maintain the back-pressure within the predetermined, desirable operating range.

In a foam reservoir print cartridge, the capillary action of the ink-soaked foam will generally be sufficient to create the desired back-pressure. In a free-ink reservoir type ink-jet pen, a variable volume, on-board, ink containment supply is often employed. As examples: the reservoir may be of a biased, flexible material which can expand or contract; an ink containment chamber may be provided which includes an internal pressure regulating device; a spring pulls an ink-filled bladder membrane outwardly to create a slight negative pressure inside the ink reservoir, a check valve in a printing device with an on-board ink reservoir that maintains a constant pressure difference between the ink reservoir and the ink-jet printhead; spring-loaded ink bag type of pressure regulated ink cartridge; diaphragm type pressure regulator located on-board an ink-jet pen using an off-board ink reservoir; or diaphragm and other atmospheric pressure controlled type mechanism pressure regulators located on-board an ink-jet pen using an off-board ink reservoir.

Back-pressure needs to be controlled within a specified tolerance limits so that the printhead can print properly. Print quality fluctuations are directly related to back-pressure fluctuations. Too little back-pressure can lead to poor print quality and ink leakage; too much back-pressure can starve the printhead which will also affect print quality and printhead life since running an ink-jet pen dry can damage the printhead mechanism. The back-pressure needs to be maintained regardless of the printing conditions, but in the prior art has fluctuated as a function of ink level in the on-axis supply (where on-axis designates a mechanism that travels with the carriage 109 (FIG. 1) during scanning) or as a function of the ink flow rate from an off-axis reservoir. In other words, a delicate balance must be maintained to prevent drooling from or depriming of the printhead nozzles.

One of the remaining technical challenges of such pen systems is the managing of ink and air remaining in the pen and printhead unit when the ink supply is decoupled. Without some means for controlling vacuum in the pen when the ink supply is removed, ink will drool from the nozzles or air will be ingested through the nozzles resulting in a deprimed condition. As consumer pricing competition increases, there is a need for simple, inexpensive systems that solve theses problems.

SUMMARY OF THE INVENTION

In its basic aspects, the present invention provides an ink-jet pen having: a pen body having a plurality of compartments, including a first compartment for retaining free-ink therein, a second compartment, at least partially superjacent the first compartment and coupled thereto, for retaining free-ink and gas therein, and a third compartment, at least partially superjacent the first compartment and coupled thereto, for retaining an ink accumulator within the third compartment; mechanisms for coupling the pen body to an ink supply; a dual capillarity ink accumulator mounted substantially within the third compartment and having a first capillarity member having a first capillary head and a second capillarity member having a second capillary head such that the first capillary head is greater than the second capillary head, and the first capillarity member is fluidically coupled to the first compartment; and a printhead fluidically coupled to the first compartment below the second compartment and the third compartment.

In another basic aspect, the present invention provides a method for preventing ink from leaking from or air from entering into an ink-jet pen through printhead nozzles during a remote ink supply disconnect condition, including the steps of: balancing volume changes of an internal gas bubble expansion and contraction against capillarity of a set of materials having different capillary head effects defined by the equation $$Pc_{low} << Pc_{high} < Pc_{nozzle},$$

where $Pc_{high}$ is the capillary head of materials having a first capillary head value, where $Pc_{low}$ is the capillary head of materials having a second capillary head value, and where $Pc_{nozzle}$ is the capillary head pressure equivalent to a pressure that the nozzles generate during ink drop firing, such that the set of materials absorb and expel ink upon the gas bubble expansion and contraction respectively. The method's step of balancing further includes balancing volume changes of an internal gas bubble expansion and contraction against capillarity of a set of materials having different capillary head effects defined by the equation $$Pc_{low} < Pc_{supply} < Pc_{high} < P_{nozzle},$$

where $Pc_{supply}$ is a total ink supply capillary head.

In another basic aspect, the present invention provides an ink-jet system including: an ink reservoir, having ink outlet mechanisms for fluidically coupling at least one ink-jet pen thereto; within the ink reservoir, a supply of ink; an ink-jet pen, having a pen body, including ink inlet mechanisms for fluidically coupling the pen to the ink reservoir, a first compartment for containing ink, a printhead mounted for receiving ink from the first compartment, the printhead having nozzles for firing ink drops therefrom, a second compartment, at least partially superjacent the first compartment and fluidically coupled thereto, for containing ink in a free liquid state and gas in the form of a bubble superjacent the ink in a free liquid state such that the bubble can expand and contract within the second compartment, a third compartment, at least partially superjacent the first compartment and fluidically coupled thereto, mounted within the third compartment, a capillary-effect ink accumulator mechanisms for preventing ink from drooling from the nozzles and air from ingesting into the printhead through the nozzles when the ink reservoir and the pen are disconnected.

In yet another basic aspect, the present invention provides an ink-jet pen device for an ink-jet pen for preventing ink from drooling from pen nozzles and for preventing air ingestion into the pen through the pen nozzles when the pen is disconnected from a fluidically coupled ink reservoir adapted for use therewith. Within the pen there is a contained bubble of gas, a dual capillarity accumulator having a first ink absorber material in contact with liquid ink within the pen such that the first ink absorber material is substantially filled with ink and a second ink absorber material such that the second ink absorber material is substantially drained of ink upon decoupling of the ink reservoir, and the accumulator absorbs and disgorges ink upon subsequent changes to ambient atmospheric temperature or pressure or both in response to changes of bubble volume therefrom. Where the ink reservoir has a capillary head of $Pc_{supply}$, the device includes the first ink absorber material and the second ink absorber material balancing volume changes of an internal gas bubble expansion and contraction within the mechanisms for containing a bubble of gas by having different capillarity factor materials having different capillary head effects defined by the equation $$Pc_{low} < Pc_{supply} < Pc_{high} < P_{nozzle},$$

where $Pc_{high}$ is a capillary head of materials having a first capillary head value, where $Pc_{low}$ is a capillary head of materials having a second capillary head value, and where $P_{nozzle}$ is a capillary head pressure equivalent to a pressure that the pen nozzles generate during ink drop firing.

It is an advantage of the present invention that it provides an ink-jet pen useful with a replaceable or replenishable ink supply.

It is another advantage of the present invention that it replaces complex, pen-incorporated, back-pressure regulator mechanisms with low cost materials performing equivalent functions.

It is an advantage of the present invention that it provides an ink-supply independent pen requiring no complex ink-transfer mechanism to retain appropriate pressure at printhead nozzles when an ink-supply is removed or attached.

It is an advantage of the present invention that it permits use of a reusable, long-life printhead pen unit with a plurality of ink supplies.

It is yet another advantage of the present invention that it permits use of relatively permanent printheads with repeated replacement of ink reservoirs.

It is an advantage of the present invention that it lowers overall manufacturing costs associated with one-time use printheads made for disposable print cartridges.

It is another advantage of the present invention that it provides an ink-jet pen that uses significantly fewer parts and therefore has a less complicated manufacturing process.

It is another advantage of the present invention that it lowers the point-of-purchase cost for end-users.

It is another advantage of the present invention that it results in a lower cost per printed page for end-users.

It is a further advantage of the present invention that it permits design of a hard copy apparatus without ink absorbers for drooling and priming pumps for repriming nozzles.

It is a further advantage of the present invention that it minimizes the possibility of spillage of ink onto the user.

It is a further advantage of the present invention that its operation is transparent to the user, requiring no user interaction.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
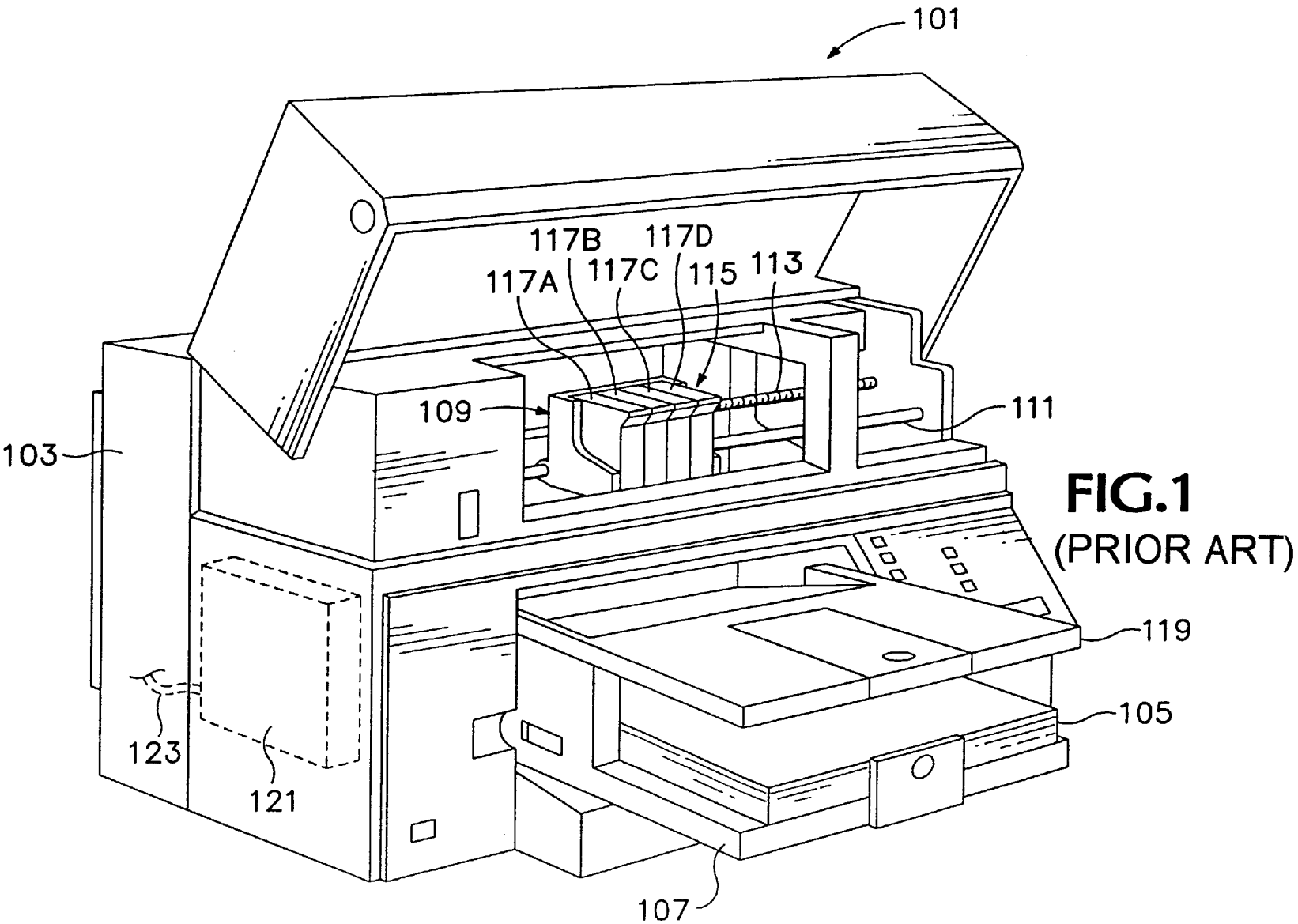
FIG.1 (PRIOR ART)
FIG. 1 (Prior Art) is a perspective view drawing of an ink-jet hard copy apparatus showing fundamental mechanisms as would be used in conjunction with the present invention.
Figure 2:
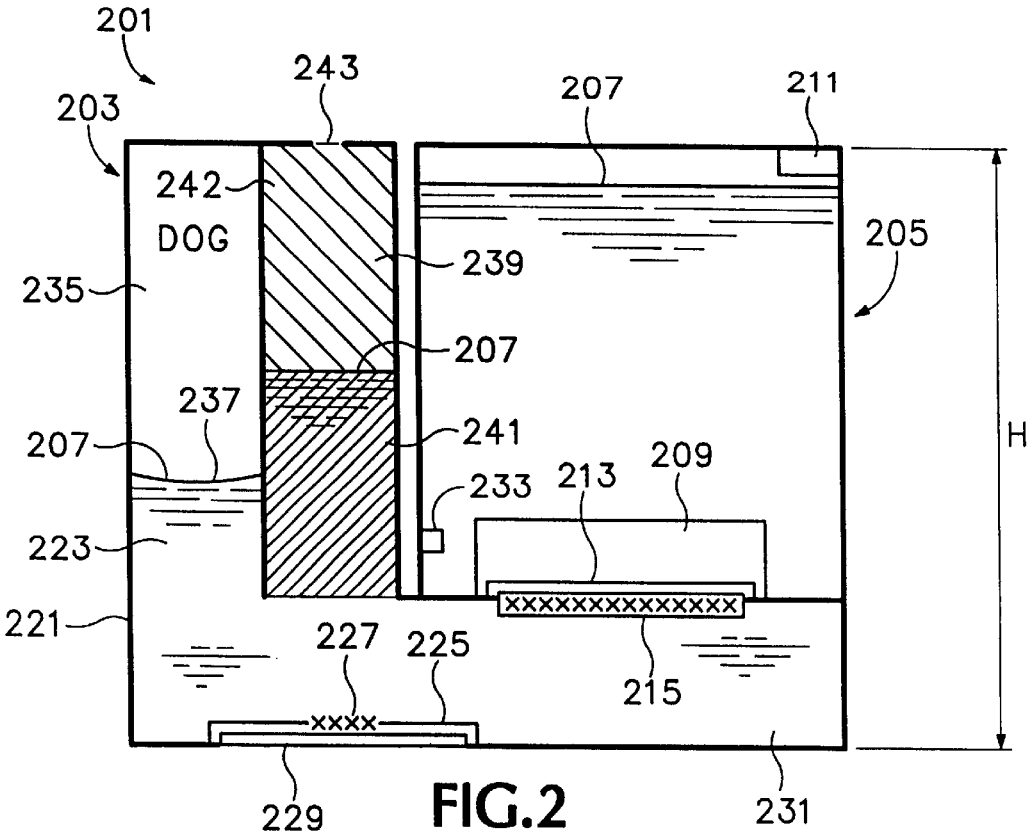
FIG. 2 is a schematic, cross-sectional, elevation view, depiction of an ink-jet pen system in accordance with the present invention, showing a filled ink supply state.

Looking to FIG. 2, a system 201 in accordance with the present invention includes an ink-jet pen 203 and a detachable ink-supply 205. The ink-supply 205 is provided with a supply of ink 207. The ink-supply 205 is of the snap-on/off, replaceable type (see e.g., European Patent Application Pub. No. 0 580 433 A1 by Canon Kabushiki Kaisha (1993); EPA Pub. No. EP 0 712 727 A2 by Seiko Epson (1995); or EPA Pub. No. EP 0 827 836 A1 by Seiko Epson (1997)). It is known in the art to have a printing operation back-pressure regulator 209 for the pen 203 and venting mechanism 211 incorporated in the ink supply 205 for controlling the flow of ink from the supply into the pen and the back-pressure at the pen's printhead 225 (see e.g. a variety of types of back-pressure mechanisms taught in U.S. Pat. No. 4,509,062 (Low et al.), U.S. Pat. No. 4,771,295 (Baker et al.), U.S. Pat. No. 4,831,389 (Chan), U.S. Pat. No. 5,537,134 Baldwin et al.), U.S. Pat. No. 5,409,134 (Cowger et al.), U.S. Pat. No. 5,448,818 (Scheffelin et al.), U.S. Pat. No. 5,574,490 (Gragg et al.), U.S. Pat. No. 5,650,811 (Seccombe et al.), or U.S. Pat. No. 5,736,992 (Pawlowski, Jr.), each assigned to the common assignee of the present invention and incorporated herein by reference); further details are not necessary for a complete understanding of the present invention. A fluid interconnect 213, a variety of which are known in the art—e.g., needle and septum, detachable manifolding, and the like-is provided for coupling and decoupling the ink-supply 205 and the pen 203. [Note that while not shown, it is within the state-of-the-art and compatible with the present invention to use an off-axis ink supply system 121, 123 as shown in FIG. 1; further detail would be readily understood by a person skilled in the art and therefore further details are not necessary for a complete understanding of the present invention. In order to simplify this description, the invention will hereinafter be described with respect to the removable, on-axis, ink-supply 205. It is not intended that to limit the scope of the invention thereto nor should any such intention be implied therefrom.] A filter screen 215 is provided for the flow path of ink 207 from the ink-supply 205 into the pen 203.

The ink-jet pen 203 includes a pen body 221. The pen body 221 incorporates an on-axis chamber 223 which is replenished from the ink supply 205 via the regulator 209, fluid interconnect 213, and filter screen 215. A printhead 225 has a fluid interconnect, such as another filter screen or semiconductor-process manifold mechanism or both, 227 fluidically coupling the printhead to the chamber 223. The printhead 225 incorporates a plurality of drop generators (not shown) as would be known in the art which includes a plurality of ink-jet nozzles 229 for firing ink drops onto an adjacently positioned print medium (not shown).

The on-axis chamber 223 has several compartments. Immediately superposing the printhead 225 is a main ink compartment 231 which is intended to remain filled with ink 207 under all operating conditions of the pen 203. A known in the art ink level detector 233 (FIG. 2) is provided either in the pen 203 or in the ink supply 205 itself to indicate the need for a replacement of the supply 205 (see e.g., U.S. Pat. No. 5,079,570, assigned to the common assignee of the present invention and incorporated herein by reference in its entirety). In the preferred embodiment, the ink level detector 233 is located so that replacement is signaled before the ink level in the pen 203 itself begins to drop due to printing after the supply 205 has gone dry.

A second compartment 235, located at least partially above the first compartment 231, will receive both ink 207 and trapped gas; the trapped gas being due in large part to a phenomenon called die out-gassing, "DOG." Thus, the second compartment 235 volume containing the gas is also referred to as "the DOG house." Ink 207 rises in the second compartment 235 to a meniscus 237 level dependent on specific implementation geometric construct and current operational conditions as will be explained in detail hereinafter. Note that it is preferable that the pen remain in an orientation, such as by its capture datums (not shown) in the carriage 109 (FIG. 1) so that the ink 207 will flow downward toward the printhead 225 and that the gas will rise into the second pen compartment 235. That is, the DOG house compartment 235 should be at a high point orientation.

In order to maintain the fluidic path connection between the ink supply 205 and the nozzles 229, the pen 203 must be kept full of ink, keeping a siphon effect therebetween. The filter 215 is preferably a fine mesh screen which both filters out particulates and acts as an air barrier between the ink supply 205 and the first compartment 231; it should take a pressure of up to −40 inches water column ("WC") to pull air through the wetted screen. This prevents air from entering the pen 203 when the supply 205 is removed and the pen from draining out ink through the nozzles 229.

A third compartment 239 is provided in a generally at least partial superjacent configuration with respect to the first compartment 231. The third compartment 239 is filled with two, capillary-action, accumulator mechanisms 241, 242. The third compartment 239 is vented to ambient atmosphere with a diffusion-resistant vent 243 (e.g., such as the vapor-barrier labyrinth vent shown in U.S. Pat. No. 5,526,030 assigned to the common assignee herein and incorporated herein by reference in its entirety). Nested in the third compartment 239 are the two capillary-action, accumulator mechanisms 241, 242 (also referred to hereinafter as simply "accumulators") having two different capillary head factors. Capillary head is defined as the height of a liquid column that can be supported by a capillary-action material due to the negative pressure generated by the meniscus at the upper surface of the liquid when considering a compartment having no ink absorbing materials therein, e.g., a free-ink, ink supply 205, "capillary head" shall mean an equivalent to an absolute value magnitude of a pressure head of the volume in the compartment. A filter screen (not shown) may be placed between the accumulator material and the third compartment 239 as a prevention against material getting loose and into the on-board ink 207 and air entering the pen chamber 223 through the materials.

The system 201 uses materials of two different capillary head effects, also referred to herein as "capillarity." The upper accumulator 242 is formed of a low relative capillarity material that provides a low capillary head sufficiently high enough to support the column of ink above the nozzles so that the nozzles will not drool. The lower accumulator 241, which is in contact with the free-ink 207 in the main ink compartment 231, is formed of a high relative capillarity material that provides a capillary head sufficiently low so as not to deprime the nozzles. The high capillarity material is configured to be in direct contact with the ink 207 and is selected to have a capillary head such that it remains substantially fully wetted with ink.

Figure 5:
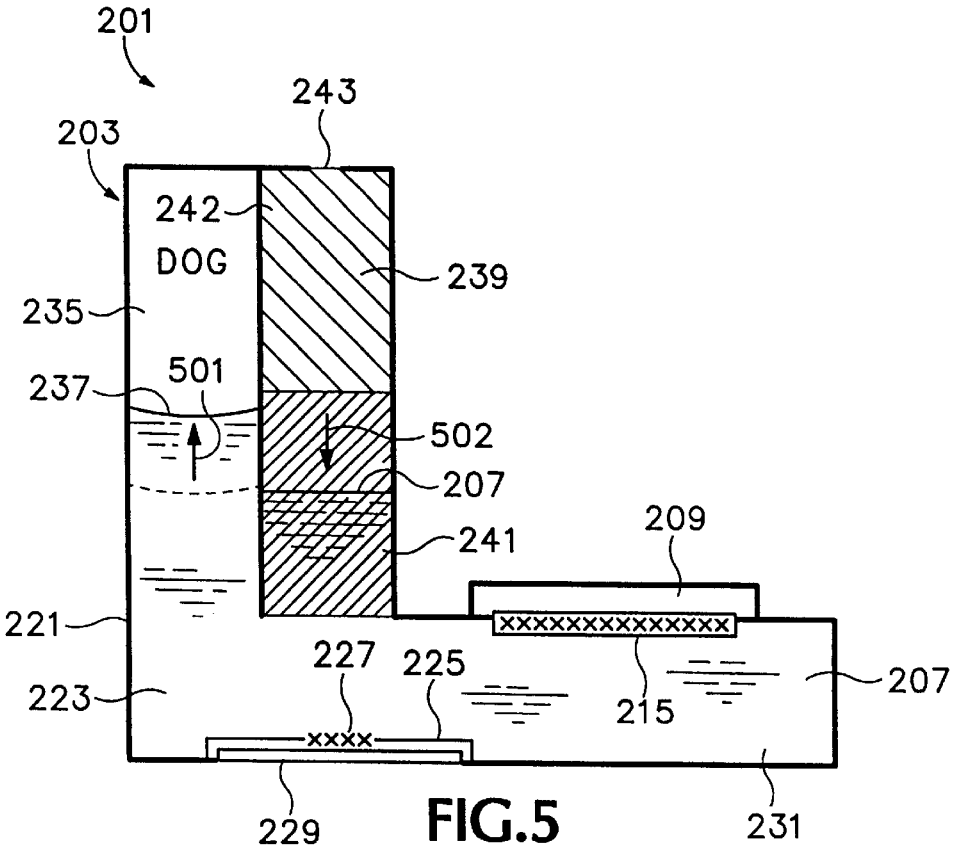
FIG. 5 is a schematic depiction of an ink-jet pen system as shown in FIGS. 2 and 3 with the ink-supply removed, showing a contracting gas bubble process.

Referring briefly to FIG. 5, with the ink supply 205 removed, a main function of the high capillarity material 241 is to expel absorbed ink into the pen compartments to compensate for DOG bubble contractions in order to prevent depriming of the nozzles 229.

The low capillarity material is configured to be in fluidic contact with the high capillarity material and is selected to have a capillary head such that it functions when the ink supply 205 is removed to either accept or release ink displaced by volume changes of the gas bubble in the DOG house compartment 235 and prevent drooling or depriming, respectively.

A main function of the low capillarity material is to absorb ink when the gas bubble expands. In general, the low capillarity accumulator should have a capillary head equal to or slightly greater than the height of the largest dimension of the pen body 221, e.g., "H" of FIG. 2 (see also FIGS. 6 and 7 for alternative embodiments), as the accumulator supports the ink in the pen when the pen is removed from the hard copy apparatus.

While the ink supply 205 is attached, and instantaneously upon removal, the high capillarity material 241 will be substantially full of ink and the low capillarity material 242 will be substantially drained of ink regardless of ambient atmospheric temperature or pressure (assuming within the design temperature and pressure ranges) because the DOG bubble volume changes due to ambient atmospheric changes are accommodated by the ink supply. Immediately after removal of the ink supply 205, the initial condition of the high capillarity material 241 is substantially full and the initial condition of the low capillarity material 242 is substantially drained (there is typically some amount of ink stranded in the low capillarity material even with an ink supply attached; this residual ink may be in the form of a thin film coating of the absorbent material pores or as small pockets of ink trapped due to pore sized variation; this has not be noted to affect operation), regardless of the instantaneous initial ambient atmospheric conditions. From this initial equilibrium, DOG bubble contraction due to temperature reduction or ambient pressure increase is accommodated by the high capillarity material which releases ink into the pen and prevents nozzle air ingestion. Conversely, from the initial equilibrium, DOG bubble expansion is accommodated by the low capillarity material, absorbing ink displaced by the bubble. Each of these processes is reversible.

The high capillarity accumulator should have a capillary head, $Pc_{high}$, lower than the equivalent capillary pressure that the nozzles generate during ink drop firing, "$P_{nozzles}$," a capillary head equivalent For example, if the nozzles can generate a pressure equivalent to support a twenty inch WC, the capillary head factor for the high capillarity accumulator 241, "$Pc_{high}$," may be only ten inches WC; the height "H" may be only two inches, thus the low capillarity accumulator should have a capillary head, "$Pc_{low}$," of approximately two inches. The examples given herein are not limitations on the scope of the invention nor should such a limitation be inferred therefrom. In general, the capillarity values can be expressed as:

$$Pc_{low} << Pc_{high} < P_{nozzle}. \quad \text{(Equation 1).}$$

Potential capillary materials for the accumulator 241, 242 include foam such as polyurethane (see e.g., U.S. Pat. No. 4,771,295), closely-spaced plates (see e.g., U.S. Pat. No. 5,010,354), closely-spaced fibers such as aligned polyester fibers and nylon materials, sintered plastic, and the like as would be known to a person skilled in the art. In the main, it is the use of materials of two different capillarities relative to the operating specifications for a particular pen and printhead that controls the specific implementation design.

In operation, with a full ink supply installed as shown in FIG. 2, the high capillarity accumulator 241 draws ink from the supply because of its relatively high capillary head. The height of the high capillarity accumulator 241 is less than the height of the total ink supply in the supply 205 and the main ink compartment 231 of the pen 203. Ink will thus rise to the top of the high capillarity accumulator 241. Now, since the total ink supply has a capillary head greater than the low capillarity accumulator 242, the ink level does not rise into the low capillarity ink accumulator material 242 except under certain conditions. In symbolic form, this can be expressed as:

$$Pc_{low} < Pc_{supply} < Pc_{high} < P_{nozzle} \quad \text{(Equation 2),}$$

where $Pc_{supply}$ is the total ink supply capillary head. This ensures that the high capillarity accumulator 241 is substantially full and the low capillarity accumulator 242 is substantially drained, regardless of ambient atmospheric temperature and pressure while the ink supply 205 is installed and instantaneously upon a disconnect. $Pc_{high}$ is less than $P_{nozzle}$ in order to ensure that the high capillarity accumulator 241 does not draw ink out of and air into the nozzles 229 and deprime the pen should the DOG bubble contract while the ink supply is removed. $Pc_{low}$ is greater than the pressure generated by the ink height remaining in the pen when the ink supply is removed and is also greater than the resulting ink height in the low capillarity accumulator 242 when the DOG bubble expands in order to ensure that ink does not leak or drool from the nozzles 229.

Figure 3:
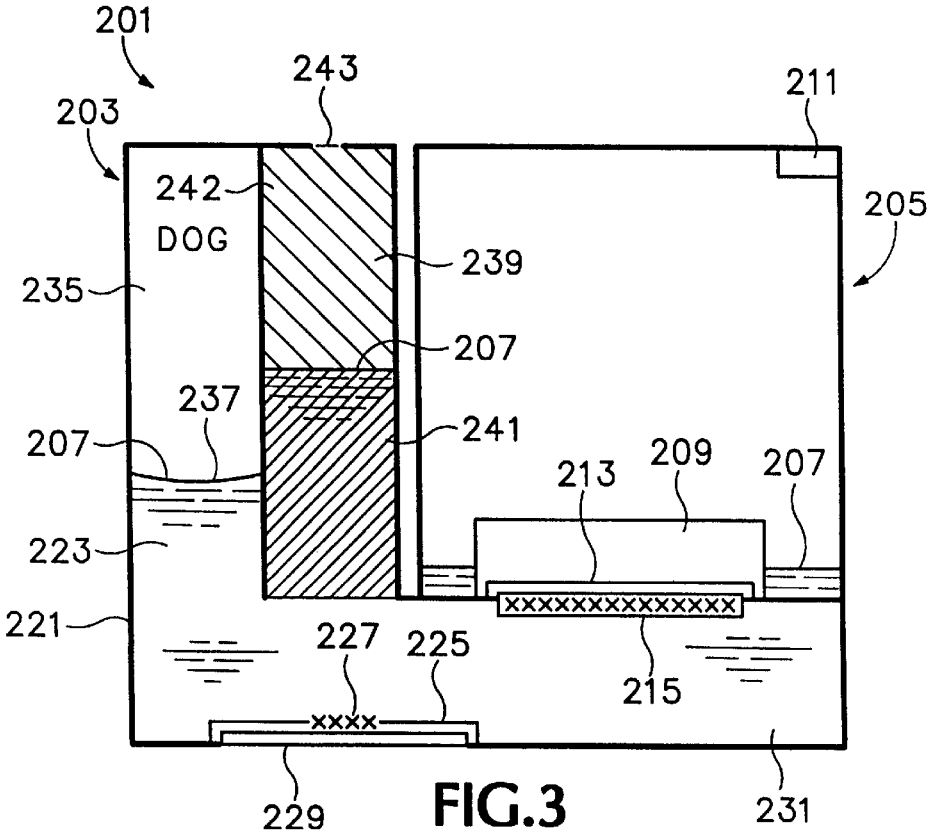
FIG. 3 is a schematic depiction of an ink-jet pen system as shown in FIG. 2 showing a substantially depleted ink supply.

During printing operations, ink 207 is depleted from the ink supply 205 until it reaches a level as shown in FIG. 3 and the supply must be replaced or replenished. With the ink supply 205 nearly empty, the ink level in the accumulator 241, 242 of the third compartment 239 remains at the top of the high capillarity accumulator 241 provided that the difference in the capillary head between the high capillary accumulator and the ink supply is greater than the height difference between the top of the high capillarity accumulator 241 and the bottom of the ink supply 205. Continuing to print after the supply is indicated to be empty will drain ink from the accumulator 241, 242 and will compromise its ability to appropriately supply ink to the printhead 225 when the DOG house 235 gas bubble volume changes as explained hereinafter. Note that in the present embodiment, regardless of the ink level in the ink supply 205, the accumulator 241, 242 is always approximately half full. When the ink supply 205 is removed, the accumulator 241, 242 is in a condition for both accepting and releasing ink as necessary to accommodate changes in the volume of the DOG house 235 gas bubble. This is depicted in FIGS. 4 and 5.

Figure 4:
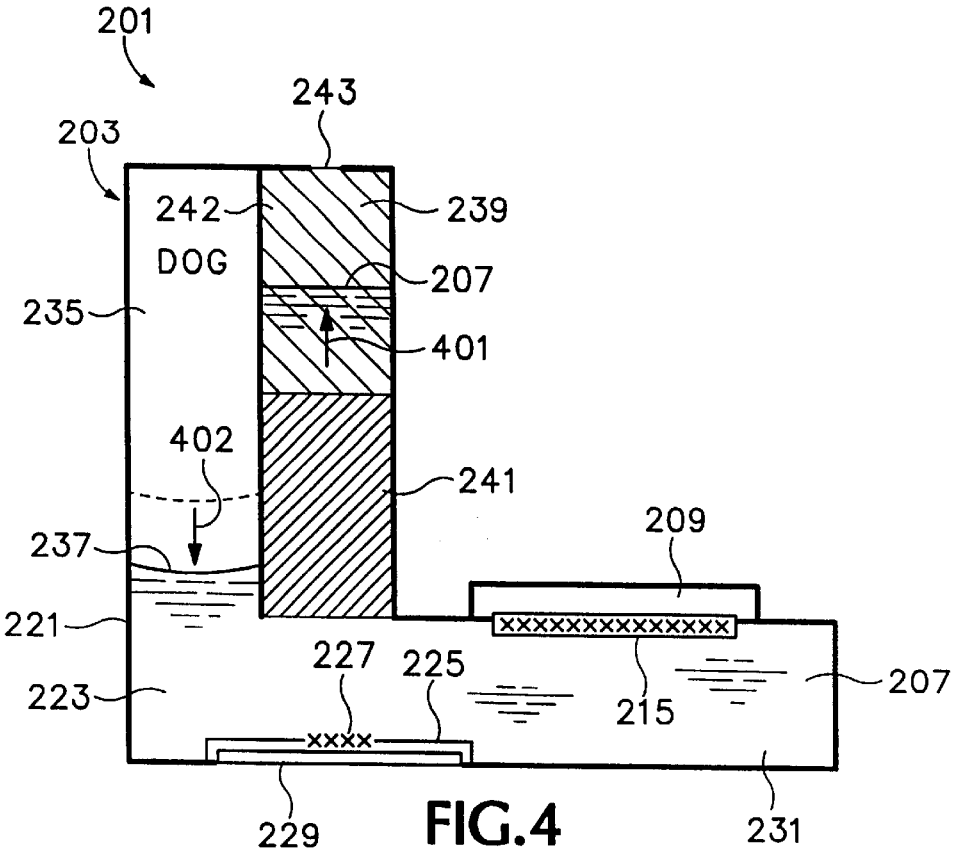
FIG. 4 is a schematic depiction of an ink-jet pen system as shown in FIGS. 2 and 3 with the ink-supply removed, showing an expanding gas bubble process.

FIG. 4 shows the case in which the DOG house bubble is expanding as can occur if the temperature of the pen is increased or if the ambient pressure decreases (e.g., by change in altitude). Under these conditions, when the pressure difference between the ink in the pen chamber 223 and the ambient environment decreases sufficiently, the low capillarity accumulator 242 will begin to absorb ink (as shown by arrow 401) while allowing the trapped gas bubble in the DOG house 235 to expand (as shown by the arrow 402). As the ink level rises from the high capillarity accumulator 241 into the low capillarity accumulator 242, the ink pressure within the nozzles 229 increases but still remains lower than ambient pressure, preventing ink in the first compartment 231 and printhead 225 from drooling from the nozzles.

FIG. 5 shows the condition in which the DOG bubble is contracting (depicted as arrow 501) as may occur for temperature decreases or ambient pressure increases. In this case, as the relative pressure in the ink decreases, the high capillarity accumulator 241 releases ink into the pen (depicted as arrow 502). The pressure at the nozzles is determined by the capillary head of the high capillarity accumulator 241 and the fluid head of the ink in the third compartment 239. Therefore, the capillary head of the high capillarity accumulator 241 is by design less than the capillary head pressure that would deprime the nozzles 229.

Note that the accumulator 241, 242 is of selected materials and sized for conditions which correspond to a maximum DOG bubble volume change associated with the design ranges of ambient temperature and ambient pressure operation. Subsequent environmental changes within the design envelope then cause the DOG bubble to contract and the low-capillarity accumulator 242 to drain. If printing occurs before the DOG bubble contracts-as would only occur if printing with a full supply or with the supply detached-then the back-pressure during printing would be determined by the low capillary head until the ink level is lowered to the boundary between the high and low capillarity materials. The design should also take into consideration DOG bubble expansion due to heating caused by prolonged printing cycles.

To summarize operation, with an ink supply 205 attached, an ink level equilibrium is established such that the high capillarity material 241 is approximately filled with ink and the low capillarity material is substantially empty of ink. The capillary head of the ink supply 205 being relatively higher than that of the low capillarity material 242 prevents that material from absorbing any ink. The capillary head of the ink supply 205 being relatively lower than that of the high capillarity material 241 allows that material to fill itself from the ink supply. This equilibrium is maintained as long as the ink supply 205 is attached and throughout the useful life of the supply. Ink displaced by DOG bubble volume variations is absorbed or released by the ink supply 205. When the supply is detached, or if there is insufficient room in the ink supply 205 to accept ink from the pen 203 (viz. if the supply full), the accumulator 241, 242 compensates for DOG bubble volume variations. From equilibrium, an expanding DOG bubble displaces ink which is absorbed by the low capillarity material 242; subsequent DOG bubble contraction draws ink from the low capillarity material until it empties at the original equilibrium state conditions. Further contraction of the DOG bubble will cause the high capillarity material 241 to release ink into the pen. Again starting from equilibrium, a contracting DOG bubble displaces ink which is released by the high capillarity material 241 into the pen; subsequent expansion of the DOG bubble allows ink to first be absorbed by the high capillarity material until it is full, then to be absorbed by the low capillarity material 242.

Figure 6:
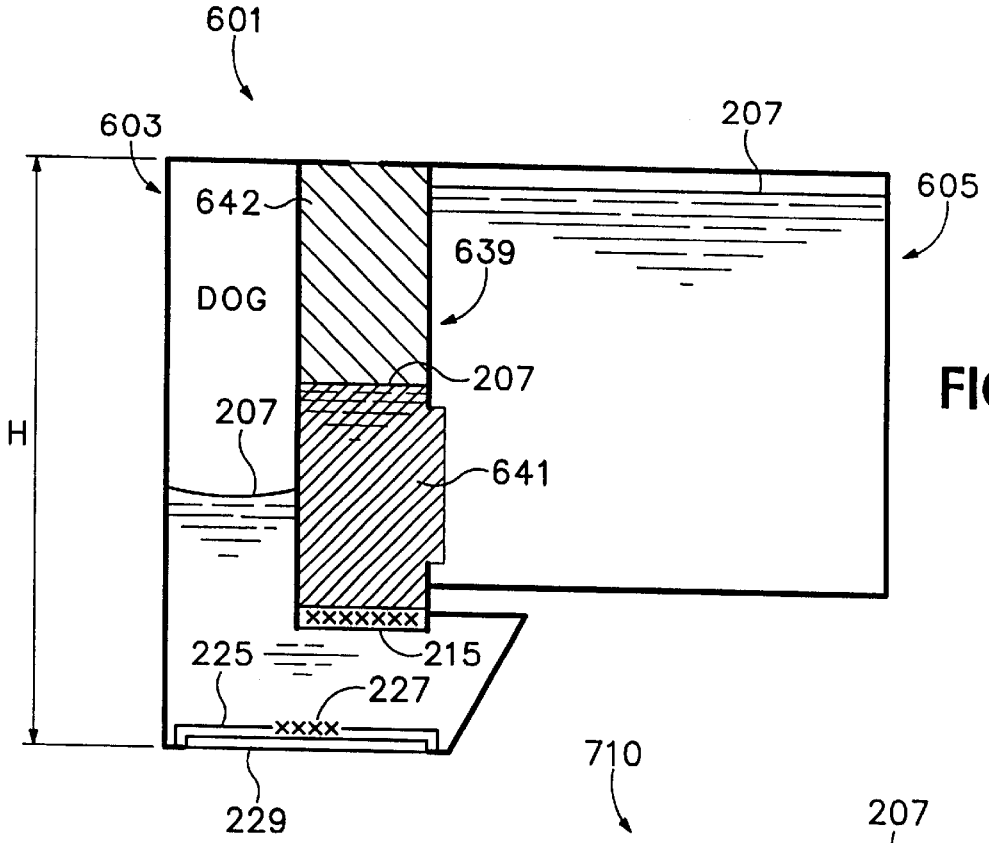
FIG. 6 is a first alternative embodiment of an ink-jet pen system in accordance with the present invention.

Shown in FIG. 6 is a simplified (i.e., leaving out known manner vents, regulators, sensors, fluidic interconnect elements that were included in FIGS. 1–5), alternative embodiment for a system 601 in accordance with the present invention. Again, a pen 603 and detachable ink supply 605 is provided. When a filter screen 215 is placed directly below the accumulator 641, 642, the ink supply 605 can be attached directly via the high capillarity accumulator 642. With the ink supply 605 removed, this would allow the ink pressure to be maintained by the accumulator 641, 642 while ensuring the filter screen 215 remains wetted on both sides. Note that the high capillarity member 641 itself can be shaped and dimensioned to form at least a part of the fluidic coupling with the ink supply 605; for example, the replaceable ink supply 605 may have a simple seal that can be penetrated by an extending region of the high capillarity member such that a force fit breaks the seal and allows the transfer of ink from the supply 605 through the high capillarity member into the compartment of the ink chamber of the pen 603 superjacent the printhead nozzles 229.

Figure 7:
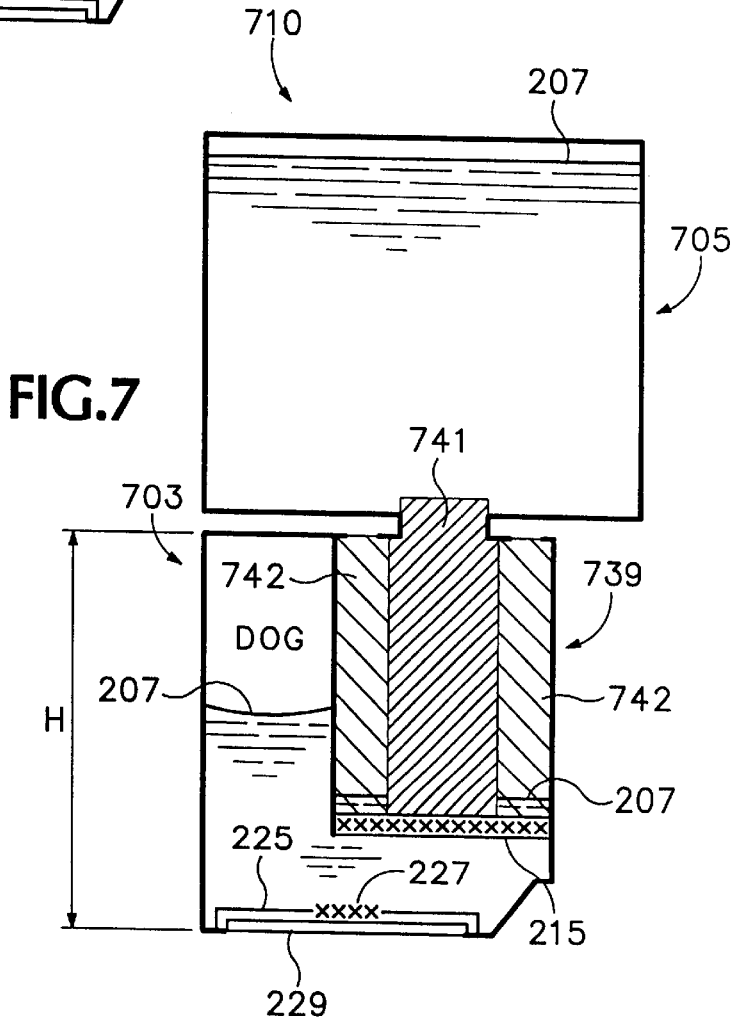
FIG. 7 is a second alternative embodiment of an ink-jet pen system in accordance with the present invention.

FIG. 7 depicts another simplified alternative embodiment for a system 710 in accordance with the present invention. Again, a pen 703 and detachable ink supply 705 is provided. The accumulator compartment 739 contains a concentric low capillarity accumulator 742 surrounding a high capillarity accumulator 741. During operation, the low capillarity accumulator 742 drains toward the nozzles 229 first.

Figure 8:
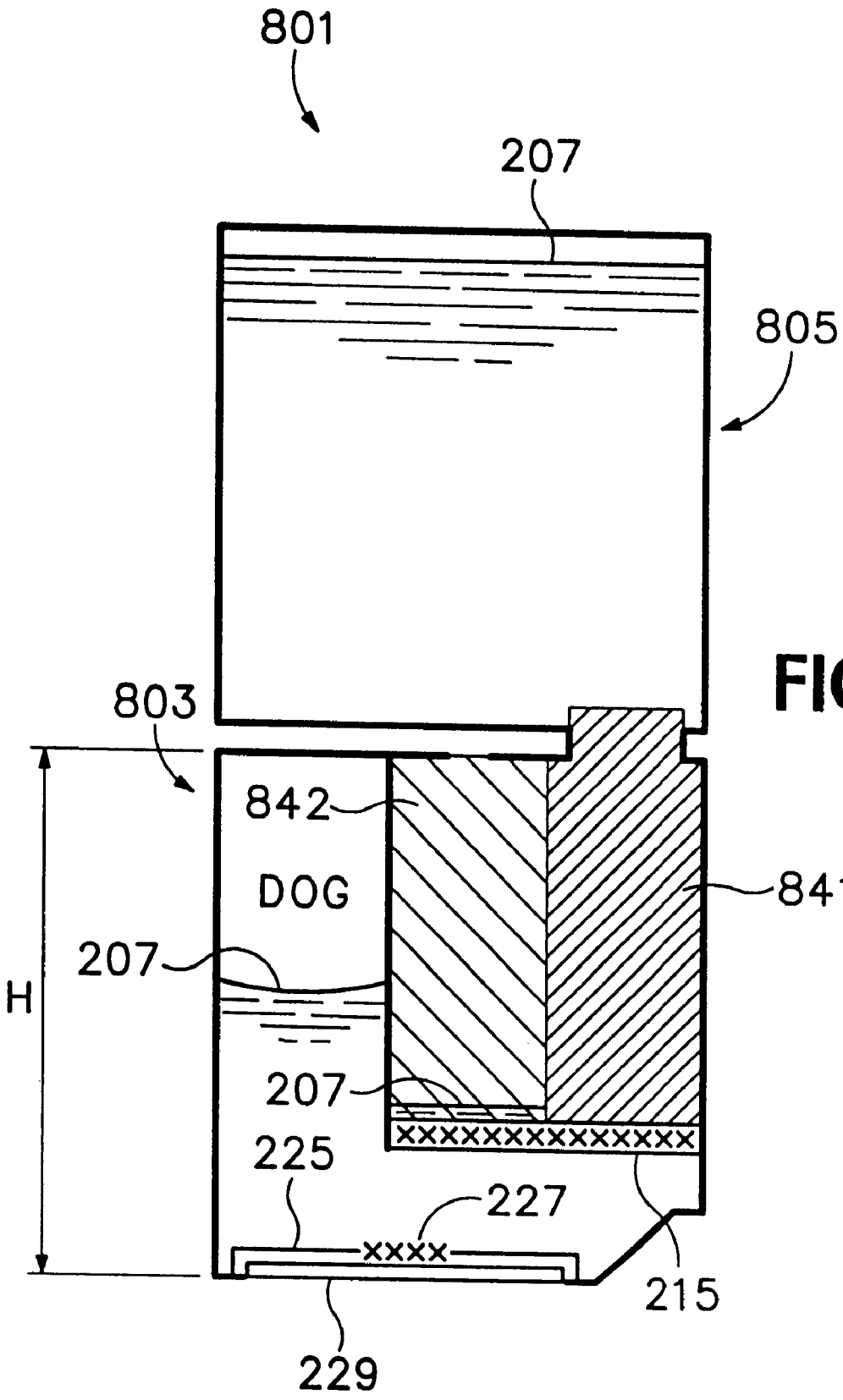
FIG. 8 is a third alternative embodiment of an ink-jet pen system in accordance with the present invention.

FIG. 8 depicts another simplified alternative embodiment for a system 801 in accordance with the present invention. A pen 803 and detachable ink supply 805 is provided. The accumulator compartment contains a side-by-side low capillarity accumulator 842 and high capillarity accumulator 841. Similarly to FIG. 7, the low capillarity accumulator 842 drains first.

Note that in a vertically stacked system 710, 801, the high capillarity accumulator 741, 841, respectively, again as in FIG. 6, can be shaped and dimensioned to extend from the pen 703, 803, respectively, such that an ink supply 705, 805, respectively, can be force fit onto the extension, eliminating need for a more complex fluid interconnect. Note that in each of the embodiments in which the accumulator also functions as the ink supply fluid interconnect, the ink supply is attached directly to the high capillarity accumulator material.

In an embodiment using a remote ink reservoir 121 as shown in FIG. 1, the high capillary accumulator is connected via a capillary wick or siphon tube to the remote ink reservoir. In the siphon tube implementation, the tube must be attached and sealed to the pen body below the saturation line of the high capillarity accumulator and provision must be made to prevent air from entering the tube.

As will be recognized by a person skilled in the art, the parameters for capillary head factors are relative to the pen and ink supply sizes, volumes, wettability of the materials, and the pen and printhead specification geometries used in any specific implementation. As also will be recognized by a person skilled in the art the pen/accumulator geometry can be mathematically derived in order to size the accumulator materials with respect to the specific implementations pen geometry and the nature of the specific materials selected as ink absorbers. The pen should be designed and sized so that for the maximum DOG bubble volume and regardless of pen orientation some ink is always in contact with the high-capillarity accumulator in order to provide a path for displaced ink to move into.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. An ink-jet system comprising:

at least one ink reservoir, having means for fluidically coupling at least one ink-jet pen thereto;

within said ink reservoir, a supply of ink;

an ink-jet pen, having a pen body, including ink inlet means for fluidically coupling said pen to said ink reservoir, a first compartment for containing ink, a printhead mounted for receiving ink from said first compartment, said printhead having nozzles for firing ink drops therefrom, a second compartment, at least partially superjacent said first compartment and fluidically coupled thereto, for containing ink in a free liquid state and gas in a bubble form, superjacent said ink in a free liquid state such that said bubble can expand and contract within said second compartment, a third compartment, at least partially superjacent said first compartment and fluidically coupled thereto, mounted within said third compartment, a dual capillary-effect ink accumulator means for preventing ink from drooling from said nozzles and air from ingesting into said printhead through said nozzles when said ink reservoir and said pen are disconnected.

2. The system as set forth in claim 1, said accumulator means further comprising:

a first ink absorber, having a first capillary head; and a second ink absorber, having a second capillary head, where said first capillary head is greater than said second capillary head, wherein said first ink absorber and said second ink absorber are fluidically connected to said first compartment.

3. The system as set forth in claim 2, said accumulator means further comprising:

said second capillary head is a value approximately equal to or greater than a capillary head value equal to the pen body's height dimension.

4. The system as set forth in claim 3, said accumulator means further comprising:

said first capillary head is a value less than a pressure equivalent value that the nozzles generate during ink drop firing.

5. The system as set forth in claim 4, further comprising:

said first capillary head is less than a value with respect to said equivalent capillary head value such that said accumulator means does not deprime said nozzles.

6. The system as set forth in claim 4, further comprising:

with said ink reservoir attached to the pen, said first capillary head has a value such that said first ink absorber is substantially filled with ink, and said second capillary head has a value such that said second ink absorber absorbs ink when said bubble expands and expels ink when said bubble contacts.

7. The system as set forth in claim 2, comprising:

in an equilibrium state, said first ink absorber is filled with ink and said second ink absorber is drained of ink.

8. The system as set forth in claim 7, comprising:

as said bubble contracts, said first ink absorber releases ink into said first compartment; and as said bubble expands, said second ink absorber absorbs ink from said first compartment.

9. An ink-jet device, for use with at least one ink supply, comprising:

an ink reservoir body for containing ink, said body including a first compartment retaining free-ink therein, a second compartment, at least partially superjacent said first compartment and coupled thereto, for retaining free-ink and gas therein, and a third compartment, at least partially superjacent said first compartment and coupled thereto, for retaining an ink accumulator within said third compartment;

a dual capillarity ink accumulator mounted substantially within said third compartment and having a first capillarity member having a first capillary head and a second capillarity member having a second capillary head such that said first capillary head is greater than said second capillary head and said first capillarity member is fluidically coupled to said first compartment;

an ink-jet printhead fluidically coupled to said first compartment below said second compartment and said third compartment; and means for transferring ink directly into said third compartment or into said first capillarity member from said ink supply.

10. The device as set forth in claim 9 comprising:

said first capillary head is a value less than a pressure equivalent value to a pressure that one of the ink-jet nozzles generates during ink drop firing.

11. The device as set forth in claim 10 comprising:

said first capillary head is a value greater than a capillary head value generated by the free-ink.

12. The device as set froth in claim 10 comprising:

said first capillarity member absorbs and expels ink in proportion to volumetric changes of said gas in said second compartment when the ink supply is decoupled from said device.

13. The device as set forth in claim 9 comprising:

said device body has a predetermined device body height dimension, and said second capillary head is approximately equal to but no less than a capillary head equivalent to the device body height dimension.

14. The device as set forth in claim 13 comprising:

said second capillary head is greater than a capillary head value equal to the device body height dimension.

15. The device as set forth in claim 14, comprising:

said second capillary member absorbs and ejects ink in proportion to volumetric changes of said gas in said second compartment when the ink supply is decoupled from the device.

16. The device as set forth in claim 9, wherein said ink reservoir body has a supply of ink generating a pressure equivalent to a capillary head defined as $Pc_{supply}$, comprising:

said first capillarity and said second capillary member balancing volume changes of an internal gas bubble expansion and contraction within said means for containing a bubble of gas by having different capillary factor materials having different capillary head effects deifed by an equation $$Pc_{low}<Pc_{supply}<<Pc_{high}<P_{nozzle},$$

where $Pc_{low}$ is a capillary head of materials having a first capillary head value, where $Pc_{high}$ is a capillary head of materials having a second capillary head value, and where $Pc_{nozzle}$ is a capillary head pressure equivalent to a pressure that the pen nozzles generate duting ink drop firing.

17. The device as set forth in claim 16 comprising:

at temperature and pressure equilibrium conditions, the first capillarity member is constructed of material having $Pc_{high}$ and is filled with ink, the second capillarity member is constructed of material having $Pc_{low}$ and is void of ink.

18. The device as set forth in claim 17, comprising:

materials having $Pc_{low}$ absorb and expel ink upon said expansion and contraction of the bubble respectively.

19. The device as set forth in claim 17, comprising:

materials having $Pc_{low}$ absorb and expel ink through the materials having $Pc_{high}$ upon said expansion and contraction of the bubble respectively.

20. The device as set forth in claim 17, comprising:

when said second capillarity member is void of ink, when said bubble contracts, materials having $Pc_{high}$ releases ink into said pen.

* * * * *